US008205720B2

(12) United States Patent
Barneman

(10) Patent No.: US 8,205,720 B2
(45) Date of Patent: Jun. 26, 2012

(54) METHOD FOR INSTALLING THE HOISTING ROPING OF AN ELEVATOR

(75) Inventor: Hakan Barneman, Solna (SE)

(73) Assignee: Kone Corporation, Helsinki (FI)

( * ) Notice: Subject to any disclaimer, the term of this patent is extended or adjusted under 35 U.S.C. 154(b) by 549 days.

(21) Appl. No.: 12/420,622

(22) Filed: Apr. 8, 2009

(65) Prior Publication Data

US 2010/0163348 A1 Jul. 1, 2010

Related U.S. Application Data

(60) Provisional application No. 61/141,606, filed on Dec. 30, 2008.

(51) Int. Cl.
*B66B 11/08* (2006.01)

(52) U.S. Cl. ..... 187/266

(58) Field of Classification Search ..... 187/414, 187/266, 900; 29/426.1, 450
See application file for complete search history.

(56) References Cited

U.S. PATENT DOCUMENTS

| | | | | |
|---|---|---|---|---|
| 5,000,292 | A * | 3/1991 | Chapelain et al. | 187/408 |
| 5,957,243 | A * | 9/1999 | Root et al. | 187/266 |
| 7,559,409 | B2 * | 7/2009 | Barneman et al. | 187/408 |
| 2002/0066622 | A1 * | 6/2002 | Pettersson et al. | 187/414 |
| 2006/0243531 | A1 * | 11/2006 | Bjorni et al. | 187/260 |
| 2006/0266589 | A1 * | 11/2006 | Anttila et al. | 187/351 |
| 2007/0181384 | A1 * | 8/2007 | Cruz | 187/411 |

FOREIGN PATENT DOCUMENTS

| | | | |
|---|---|---|---|
| JP | 2001-287878 | A | 10/2001 |
| JP | 2004-315137 | A | 11/2004 |
| JP | 2007-276995 | A | 10/2007 |
| WO | WO 2005/058740 | A1 | 6/2005 |
| WO | WO 2006/079681 | A1 | 8/2006 |
| WO | WO 2007/128859 | A1 | 11/2007 |

* cited by examiner

*Primary Examiner* — Michael Mansen
*Assistant Examiner* — Michael Riegelman
(74) *Attorney, Agent, or Firm* — Birch, Stewart, Kolasch & Birch, LLP

(57) ABSTRACT

A method for installing the hoisting roping of an elevator, the elevator including at least an elevator car that moves in essentially a vertical direction in the elevator hoistway, a hoisting machine, a traction sheave, and at least a plurality of diverting pulleys includes fitting a plurality of hoisting ropes to pass around a plurality of diverting pulleys as well as the traction sheave, the hoisting ropes, after the installation, forming the hoisting roping of the elevator. Each hoisting rope is guided to pass around each diverting pulley and/or the traction sheave such that a loop is formed from the part between the first and second end of the hoisting rope, the loop being fitted to pass around the diverting pulley and/or the traction sheave.

6 Claims, 6 Drawing Sheets

METHOD FOR INSTALLING THE HOISTING ROPING OF AN ELEVATOR

CROSS-REFERENCE TO RELATED APPLICATIONS

This application claims priority under 35 U.S.C. §119(e) to U.S. Provisional Application No. 61/141,606, filed on Dec. 30, 2008, the entirety of which is expressly incorporated herein by reference.

BACKGROUND OF THE INVENTION

1. Field of the Invention

The present invention relates to a method for installing the hoisting roping of an elevator 2. Description of Background Art The hoisting roping of an elevator is usually installed such that the ropes are pulled from a reel or from a roll and the rope is led end first around the rope pulleys, i.e. the traction sheave and the diverting pulleys. The problem with this solution is that pulling the ropes in the final phase of the actual installation is physically very heavy and unergonomic owing to the weight of the ropes and the frictions. This problem is especially prominent in high-rise buildings. In addition, owing to the difficult working conditions and also working positions, the risk of accidents is great. The installation work with conventional methods is also extremely slow.

SUMMARY OF THE INVENTION

The purpose of the present invention is to eliminate the aforementioned drawbacks and to achieve an easy and quick as well as an ergonomic and safe method for installing the hoisting roping of an elevator. The present invention is directed to a method for installing the hoisting roping of an elevator, the elevator comprising at least an elevator car that moves in essentially a vertical direction in the elevator hoistway, a hoisting machine, a traction sheave, and a plurality of diverting pulleys. The method includes the steps of fitting a plurality of hoisting ropes to pass around a plurality of diverting pulleys and the traction sheave, the plurality of hoisting ropes forming the hoisting roping of the elevator after the installation; guiding each of the plurality of hoisting ropes to pass around at least some of the diverting pulleys and/or the traction sheave such that a loop is formed from a part between first and second ends of the hoisting rope; and fitting the loop to pass around the diverting pulley and/or the traction sheave.

Some inventive embodiments are also discussed in the descriptive section of the present application. The inventive content of the application can also be defined differently than in the claims presented below. The inventive content may also consist of several separate inventions, especially if the present invention is considered in the light of expressions or implicit sub-tasks or from the point of view of advantages or categories of advantages achieved. In this case, some of the attributes contained in the claims below may be superfluous from the point of view of separate inventive concepts. Likewise the different details presented in connection with each embodiment of the present invention can also be applied in other embodiments. In addition it can be stated that at least some of the subordinate claims can in at least some situations be deemed to be inventive in their own right.

One advantage of the method according to the present invention, among others, is that the installation work is safe, the ergonomics is good and there is no heavy physical work in any work phase. In this case also the long hoisting ropes are easy and safe to install. Another advantage is that installation of the hoisting ropes is quick to perform.

Further scope of applicability of the present invention will become apparent from the detailed description given hereinafter. However, it should be understood that the detailed description and specific examples, while indicating preferred embodiments of the present invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
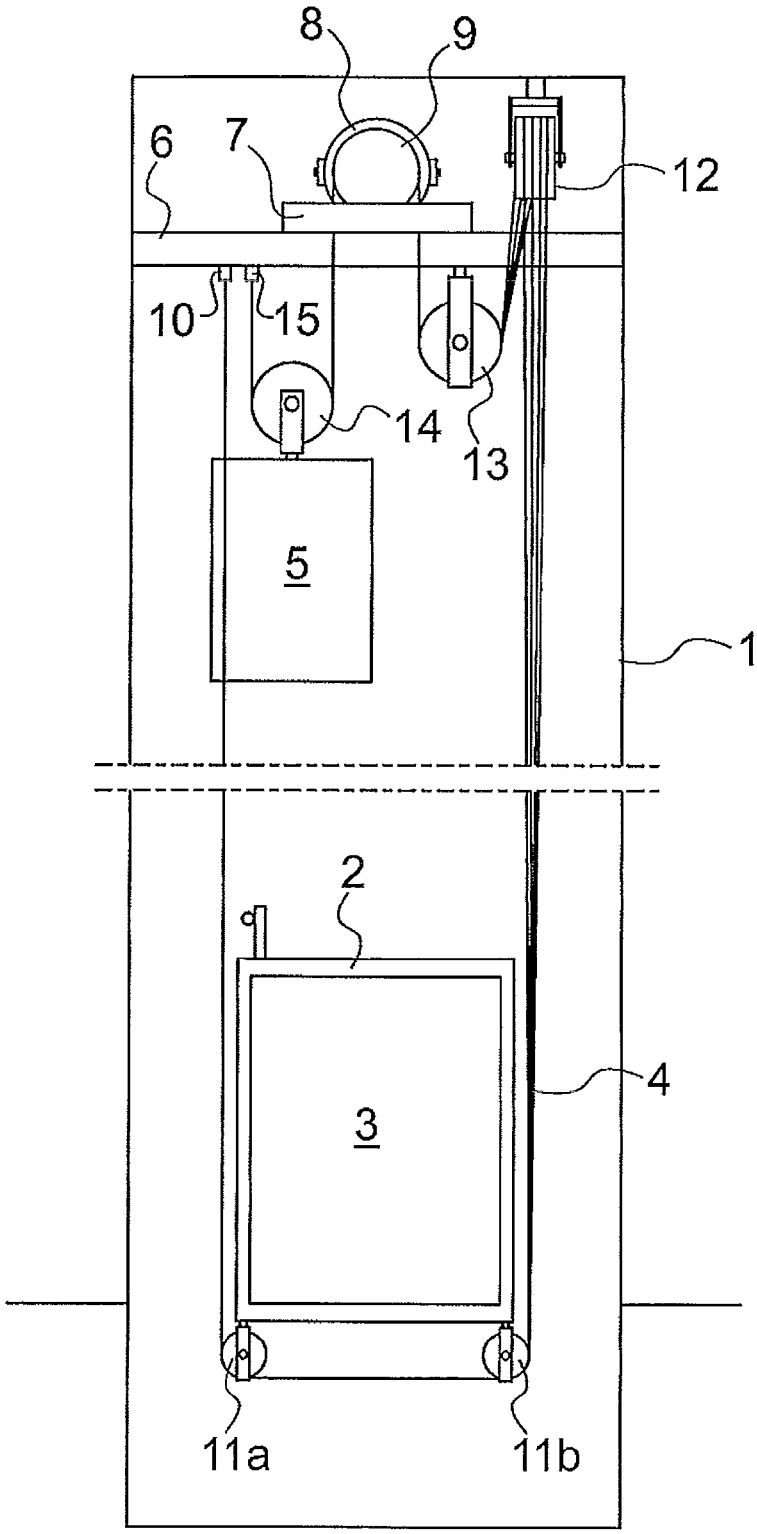
FIG. 1 is a simplified and diagrammatic side-view of a traction sheave elevator with counterweight and its roping solution, in which the method according to the present invention can be used.

The present invention will now be described with reference to the accompanying drawings, wherein the same reference numerals have been used to identify the same or similar elements throughout the several views.

FIG. 1 presents a traction sheave elevator with counterweight, in which the installation method according to the present invention can be used. The elevator car 3 fitted inside the car sling 2 is fitted to travel essentially vertically to and fro in the elevator hoistway 1. The elevator car 3 is suspended on the hoisting roping 4, as is also the counterweight 5. The hoisting machine 8 of the elevator with its traction sheave 9 is fitted into the top part of the elevator hoistway 1 on top of the overhead beam 6 of the hoistway and the pedestal 7. The elevator receives its lifting force from the hoisting machine 8 as a result of the friction between the traction sheave 9 and the hoisting roping 4.

The hoisting roping 4 is fixed at its first end to the overhead beam 6 of the elevator hoistway or to some other suitable fixing point 10, from where the hoisting roping is passed below the elevator car 3 around the diverting pulleys 11*a* and 11*b*, after which over the diverting pulley 12 in the top part of the elevator hoistway 1. From here the hoisting roping 4 is led below the diverting pulley 13 fixed to the overhead beam 6 of the hoistway, from where onwards over the traction sheave 9. From the traction sheave 9 the hoisting roping 4 is led downwards to pass below the diverting pulley 14 of the counterweight 5, after which to the fixing point 15 on the overhead beam 6 of the hoistway, to which the hoisting roping 4 is fixed at its second end.

Figure 2:
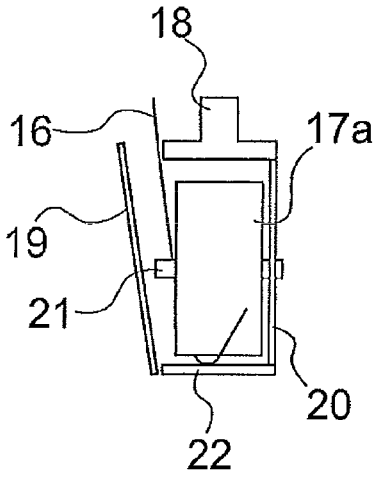
FIG. 2 is a front view of a diverting pulley.
Figure 3:
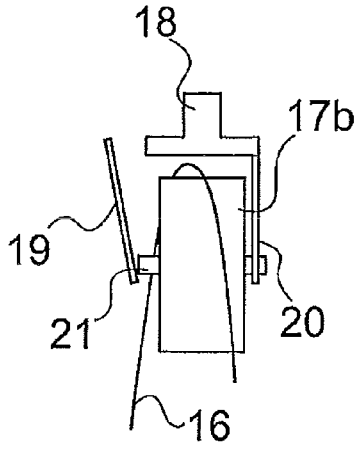
FIG. 3 is a front view of another type of diverting pulley.
Figure 4:
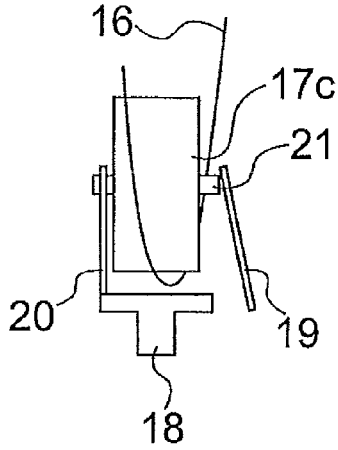
FIG. 4 is a front view of yet another type of diverting pulley.

FIGS. 2, 3 and 4 present front views of three different diverting pulleys that are used in this embodiment as well as a method with which the hoisting rope is installed onto each diverting pulley. The diverting pulleys 11*a* and 11*b* on the bottom part of the elevator car 3 as well as the diverting pulley 13 fixed to the overhead beam 6 of the hoistway are structurally the same models and are fixed to the side supports 19 and 20 by their shafts 21 and each side support is fixed to the fixing element 18 above its diverting pulley, with which the diverting pulley is fixed in position. In addition a jump guard 22, which prevents the hoisting ropes jumping off the diverting pulley, is fixed to the bottom ends of the side supports 19 and 20 below the diverting pulley 11*a*, 11*b*, 13. The hoisting rope 16 is installed to pass below the diverting pulley 11*a*, 11*b*, 13 such that the first side support 19 is detached and the hoisting rope 16 is fitted onto the diverting pulley as a loop from the side. After this the first side support 19 is fixed back into position.

The diverting pulley 12 fixed to the top part of the elevator hoistway 1 is presented in FIG. 3. In this case the hoisting rope 16 is installed to pass over the diverting pulley 12 from the side in the manner of the diverting pulley of FIG. 2 by detaching the first side support 19 and by fixing it back into position after installation. In this diverting pulley the fixing element 18 functions as a jump guard.

The diverting pulley 14 fixed on top of the counterweight 5 is presented in FIG. 4. The hoisting rope 16 is installed to pass below the diverting pulley 14 from the side in the manner of the diverting pulleys of FIGS. 2 and 3 by detaching the first side support 19 and by fixing it back into position after installation. Also in this diverting pulley 14 the fixing element 18 functions as a jump guard.

The idea of the method according to the present invention is thus that the hoisting rope 16 is not installed onto the diverting pulleys with the end of the rope first but instead the diverting pulley is opened from its first side and the hoisting rope 16 is fitted onto the diverting pulley as a loop from the side of the diverting pulley. In the following figures one embodiment of the method according to the present invention is presented phase-by-phase.

Figure 5:
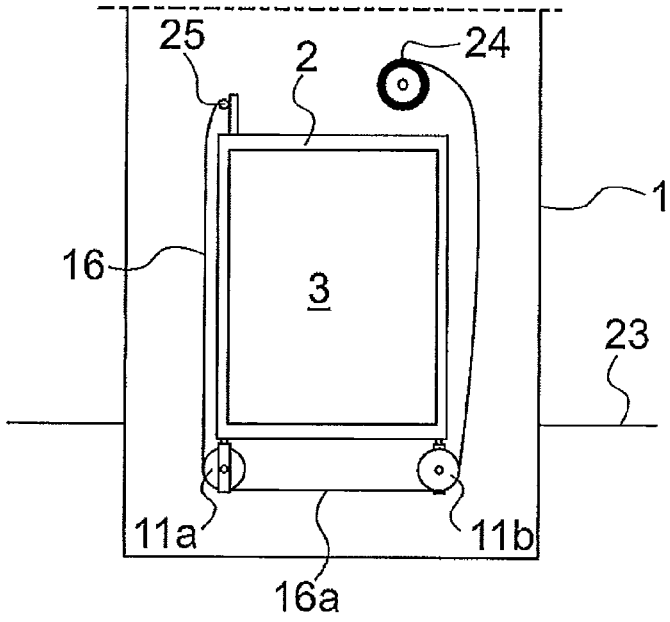
FIG. 5 is a simplified and diagrammatic side view of the initial phase of the method according to the present invention.

FIG. 5 presents a side view of the initial phase of the method according to the present invention. The elevator car 3 is in the bottom part of the elevator hoistway, in which case it can be accessed for handling from the lowermost floor level 23. The parallel hoisting ropes 16 to be installed are on coils or reels 24. For the sake of clarity, only one hoisting rope 16 and one reel 24 are drawn in the figures. Initially the first ends of the ropes 16 are fixed to a rail on the roof of the elevator car 3 that functions as a temporary fixing point 25 on the first side elevator car 3. Then the amount of rope that is sufficient for the ropes to pass below the elevator car 3 is uncoiled from the reels 24. The diverting pulleys 11*a* and 11*b* fixed to the bottom part of the elevator car 3 are opened, as is described above, and each hoisting rope 16 is fitted onto the diverting pulleys as a loop 16*a*, after which the diverting pulleys 11*a* and 11*b* are closed. In the situation of FIG. 5 the first diverting pulley 11*a* is already closed but the second diverting pulley 11*b* is still open. In this phase the ropes 16 can also be threaded below the diverting pulleys 11*a* and 11*b* that are closed from the side.

Figure 6:
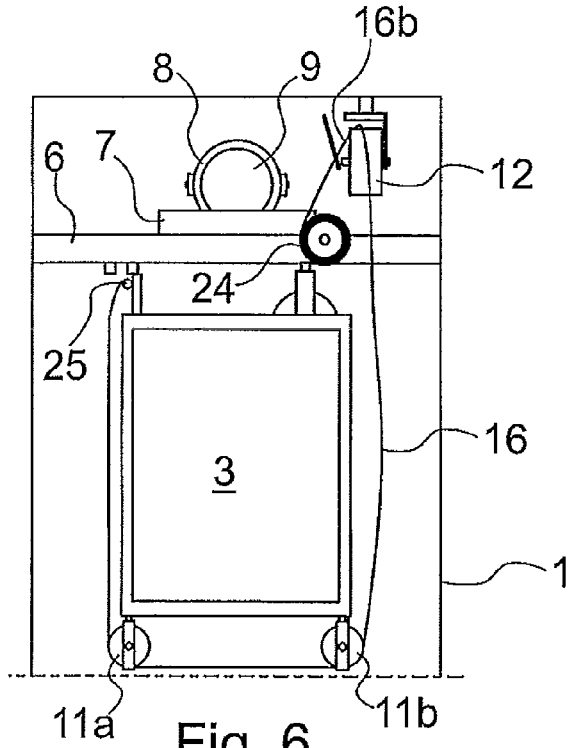
FIG. 6 is a simplified and diagrammatic side view of the phase following FIG. 5, in which the elevator car has been lifted to the upper part of the hoistway.

FIG. 6 presents the next phase of the method. The elevator car 3 is lifted by means of, e.g. an auxiliary hoist to a suitable height in the upper part of the elevator hoistway 1 such that the diverting pulley 12 can be handled from the roof of the elevator car 3. The rope reels 24 are lifted upwards along with the elevator car 3, releasing rope from the reels at the same time. The diverting pulley 12 is opened from the side, as is described above, and each hoisting rope 16 is installed to pass over the diverting pulley 12 as a loop 16*b*, after which the diverting pulley 12 is closed.

Figure 7:
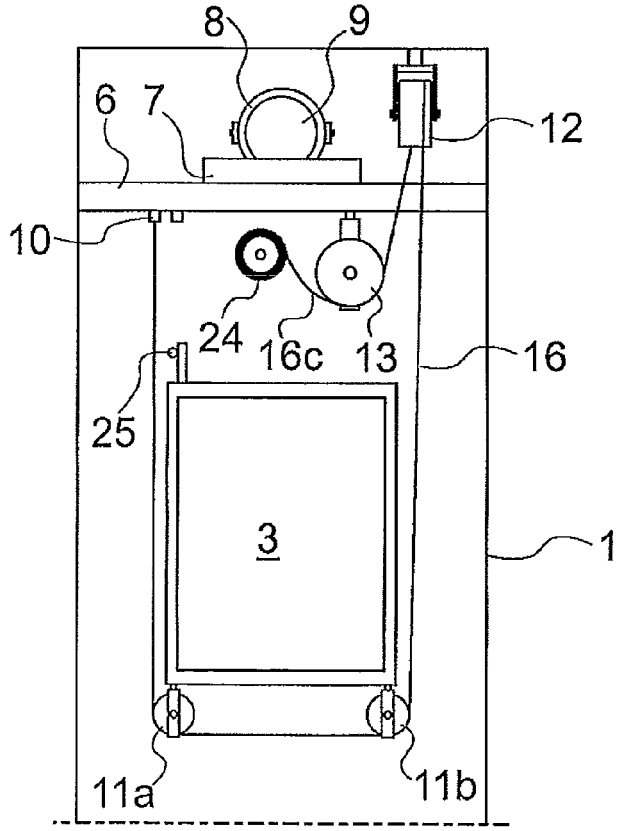
FIG. 7 is a simplified and diagrammatic side view of the phase following FIG. 6.

FIG. 7 presents the next phase of the method. The first ends of the hoisting ropes 16 are detached from the rail 25 and they are fastened to their proper fastening point 10. The elevator car 3 is lowered to below the diverting pulley 13 fixed to the overhead beam 6 of the elevator hoistway such that the diverting pulley 13 can be handled from the roof of the elevator car. The reels 24 are moved again along with the car at the same time uncoiling the same amount of rope from the reels as the distance traveled. After this the diverting pulley 13 is opened from the side, each rope 16 is installed to pass in the lateral direction below the diverting pulley 13 as a loop 16*c*, after which the diverting pulley 13 is closed.

Figure 8:
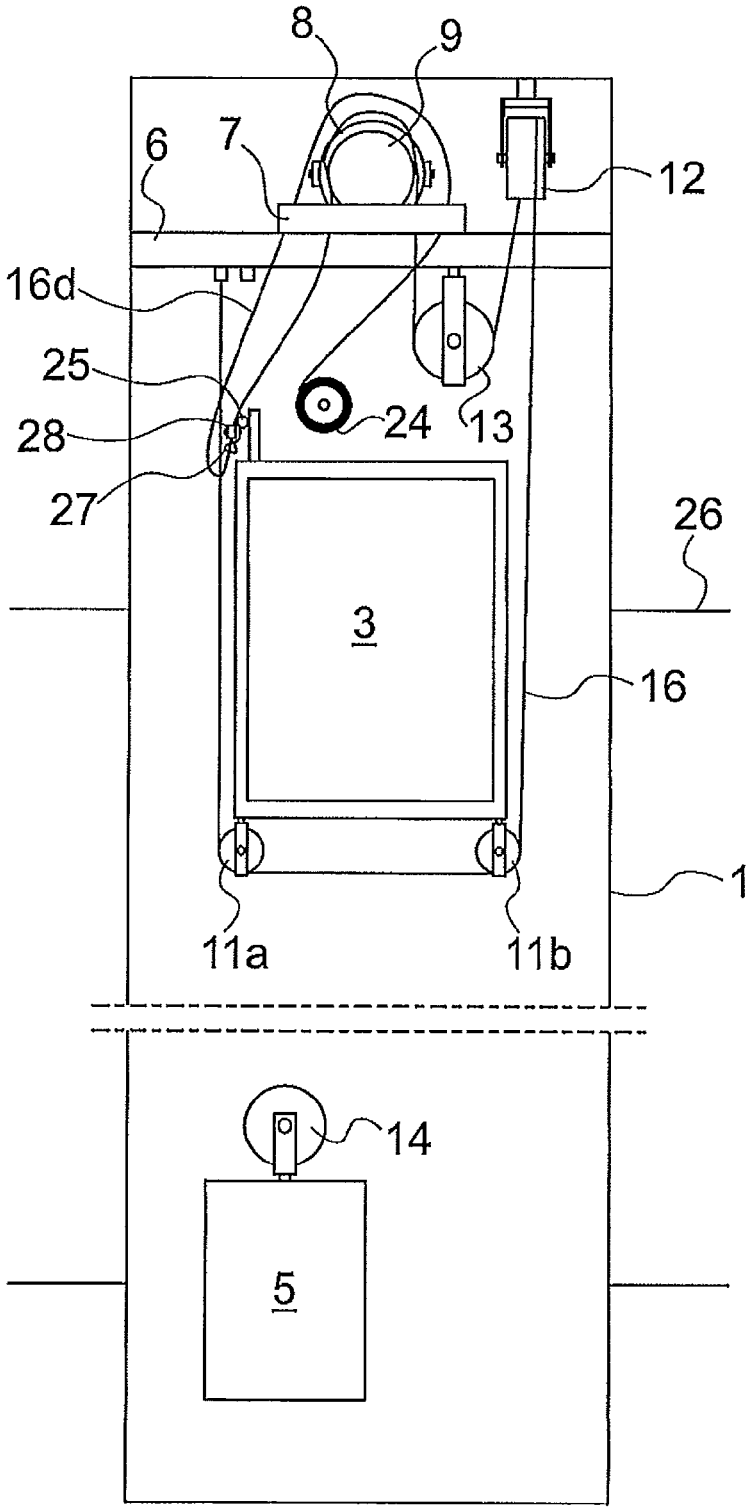
FIG. 8 is a simplified and diagrammatic side view of the phase following FIG. 7.

FIG. 8 presents the next phase of the method, in which the hoisting ropes 16 are arranged to pass over the traction sheave 9. The elevator car 3 is moved in the hoistway 1 to a height from where access to the roof of the car is possible from the topmost floor level 26. Correspondingly the counterweight 5 is lifted from the bottom of the hoistway 1 to a height that corresponds to the height of the counterweight 5 when the hoisting ropes 16 are in their positions and the elevator car 3 is at the height to which it was placed before this. In the aforementioned dimensioning the flexible clampings of the fixing points of the hoisting ropes 16 as well as rope stretchings are also taken into account.

After this the hoisting ropes 16 are installed one at a time to completion. A loop 16*d* is made from the first hoisting rope 16, which is lifted as a loop through the pedestal 7 over the traction sheave 9, after which the loop 16*d* is led from the other side of the traction sheave 9 through the pedestal 7 downwards to back below the overhead beam 6 of the hoistway. Then the part of the loop 16*d* formed from the hoisting rope 16 on the side of the elevator car 3 is fitted temporarily to the eyelet 27 fixed to the top rail 25 of the elevator car 3, and the locking element 28, which does not fit through the eyelet 27, is fixed to the rope above the eyelet 27. Owing to this arrangement the loop 16*d* can be lowered in a controlled manner to the bottom part of the elevator hoistway 1, since only the second half of the loop 16*d* is lowered downwards. As presented above the hoisting rope 16 can be threaded as a loop through the pedestal 7 or corresponding. The guiding of the hoisting rope 16 as a loop over the traction sheaves in the manner described enables, among other things, the roping of traction sheaves with a structure that is not reasonable or that cannot be opened. In this type of traction sheave the rope groove surface of the traction sheave is at least in places surrounded by the frame structure of the traction sheave, between which frame structure and rope groove surface the rope is guided to pass. In this case the hoisting rope can be guided to pass as a loop over the traction sheave by guiding the hoisting rope loop between the rope groove surface and the frame structure tangentially with respect to the traction sheave. Correspondingly, when an elevator with machine room is possibly in question, the hoisting rope 16 could be threaded through the holes in the machine room floor.

Figure 9:
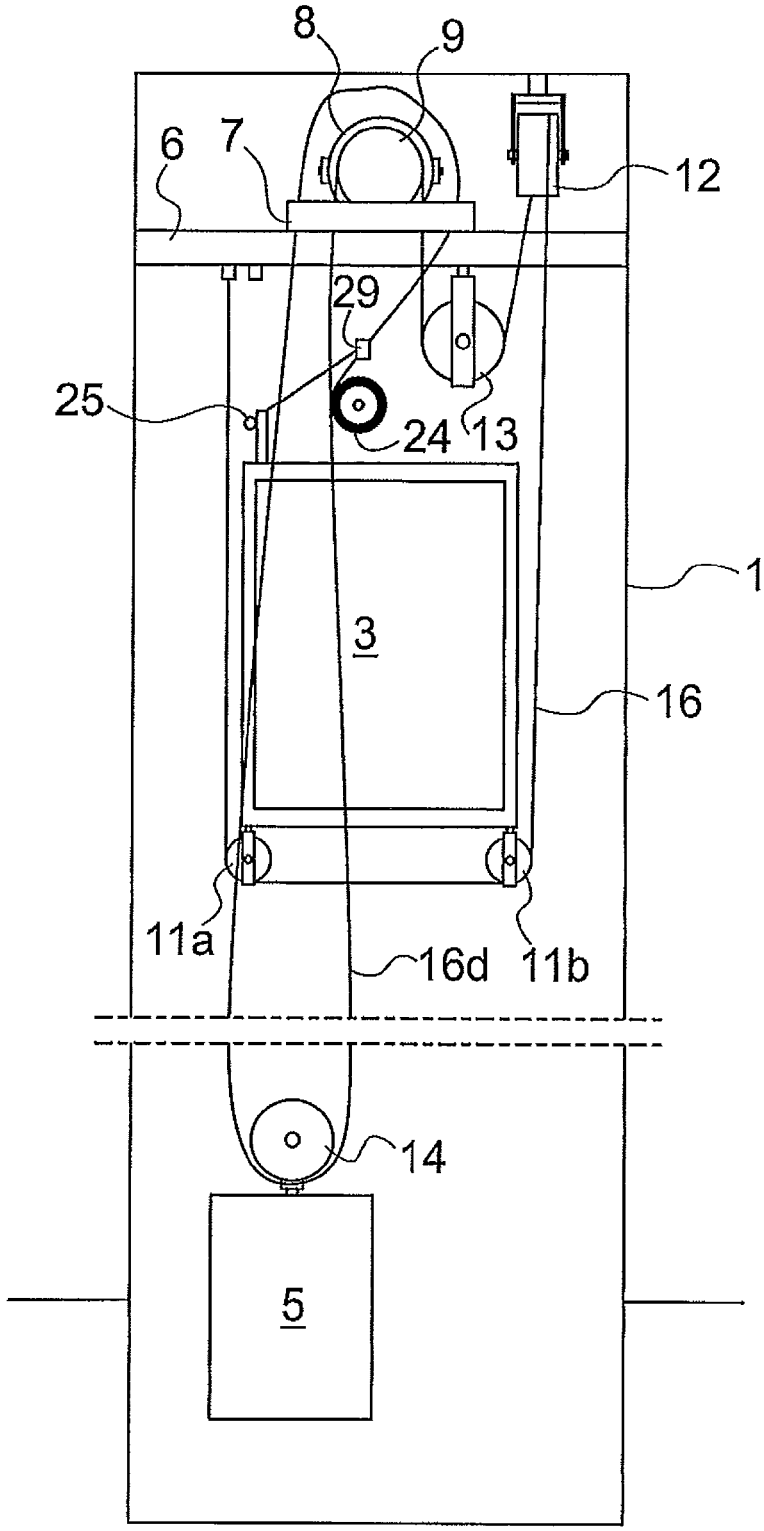
FIG. 9 is a simplified and diagrammatic side view of the phase following FIG. 8.

FIG. 9 presents the next phase of the method. Next the diverting pulley 14 of the counterweight 5 is opened and the loop 16*d* formed from the hoisting rope 16 is lowered to the counterweight 5 in the bottom part of the hoistway 1. The locking element 28 is detached from the rope 16, the loop 16*d* is detached from the eyelet 27 and possible dents in it are removed, after which the part of the rope 16 on the side of the elevator car 3 is fixed to the rail 25 of the elevator car by means of the clamp 29 near the reel 24, which prevents the rope 16 from discharging from the reel 24. After this the loop 16*d* is fitted onto the diverting pulley 14 from the side as described earlier.

Figure 10:
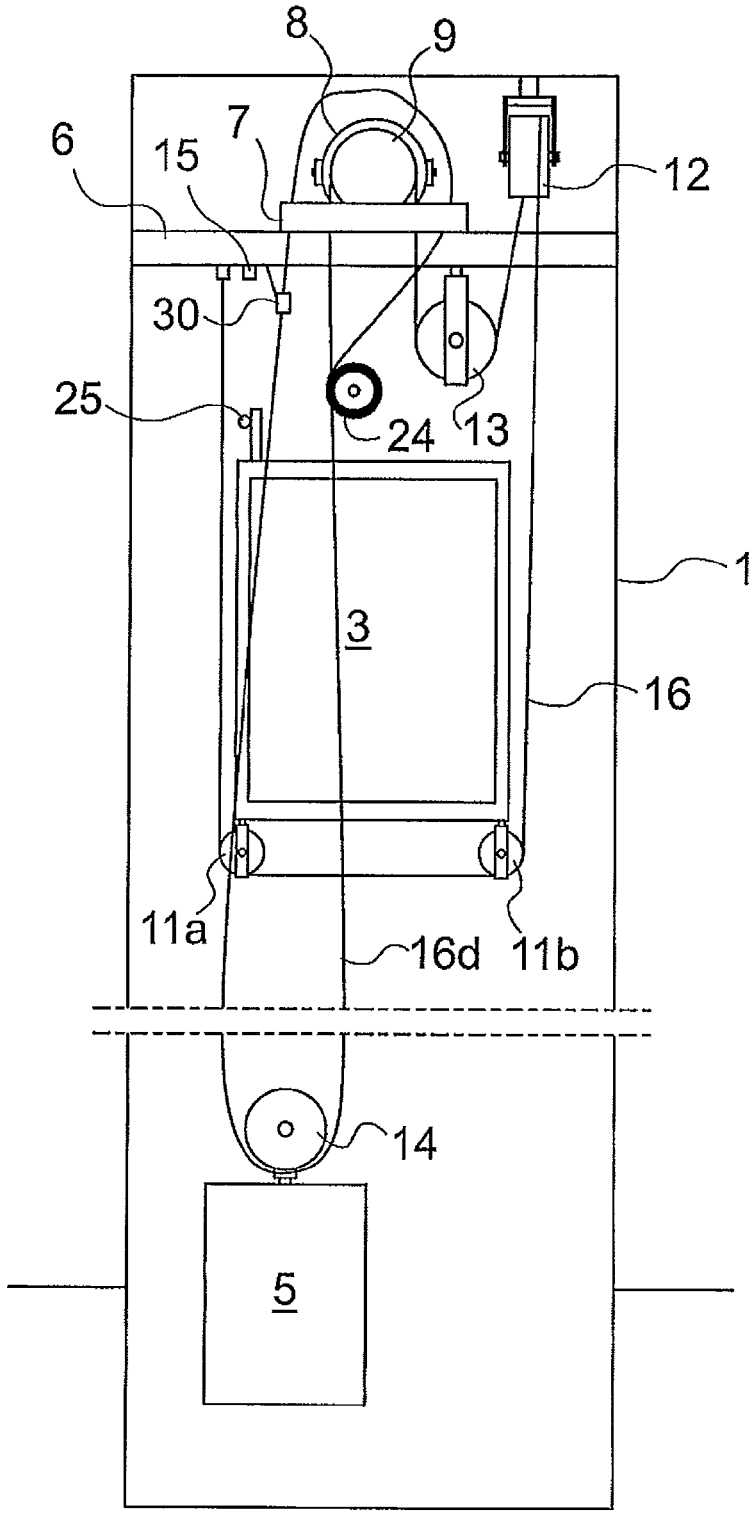
FIG. 10 is a simplified and diagrammatic side view of the phase following FIG. 9.

FIG. 10 presents the next phase of the method. The rope 16 is detached from the rail 25 of the elevator car and fixed from the side of the counterweight 5 to the overhead beam 6 of the elevator hoistway or to some other suitable place by means of a short rope and a clamp 30. Then the last part of the rope 16 is drawn from the reel 24 through the pedestal 7 to the side of the counterweight 5, is detached from the overhead beam 6 of the hoistway and fixed to its final fixing point 15. Finally, it is checked that the rope 16 is in its correct position and the rope 16 is cut to its correct dimension.

The phases presented in the description parts of FIGS. 8, 9 and 10 are performed for each rope of the hoisting roping 4, after which the diverting pulley 14 is closed. Finally it is checked that all the ropes are properly in their position, the auxiliary hoist is detached, the leveling runs are driven and in addition any final adjustments needed are made. The final roping is presented in FIG. 1 above.

It is obvious to the person skilled in the art that the present invention is not limited solely to the examples described above, but that it may be varied within the scope of the claims presented below. Thus, for example, the suspension of the elevator car can be different to what is presented above. The positioning and number of the diverting pulleys can vary, in which case certain details of the rope installation are different than those explained in the example above.

It is also obvious to the person skilled in the art that the sequence of the different phases of the method can differ to that presented.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method for installing a hoisting roping of an elevator, the elevator comprising at least an elevator car that moves in essentially a vertical direction in the elevator hoistway, a counter weight, a hoisting machine, a traction sheave, and a plurality of diverting pulleys including a counterweight diverting pulley, said method comprising the steps of:

locating a plurality of hoisting ropes around the plurality of diverting pulleys, the plurality of hoisting ropes forming the hoisting roping of the elevator after the installation;

locating each of the plurality of hoisting ropes around the traction sheave by forming a loop with a segment of a corresponding one of the hoisting ropes; and guiding the loop from a first side of the traction sheave, over the traction sheave, to a second, opposite side of the traction sheave;

increasing the length of the loop located on the second side of the traction sheave; and locating the loop around the counterweight diverting pulley after the step of increasing the length of the loop located on the second side of the traction sheave.

2. The method according to claim 1, further comprising the step of pulling the plurality of hoisting ropes along with the elevator car when the elevator car is moved in the elevator hoistway.

3. The method according to claim 1, furter comprising:

after guiding the loop from the first side of the traction sheave, over the traction sheave, to the second, opposite side of the traction sheave, and before locating the loop around the counterweight diverting pulley, temporarily fixing a part of the loop on the second side of the traction sheave to an eyelet that is fixed to a top rail of the elevator car; and fixing a locking element to the loop at the second side of the traction sheave and above the eyelet;

wherein the step of increasing the length of the loop on the second side of the traction sheave is performed by lowering down a second half of the loop toward the counterweight diverting pulley.

4. The method according to claim 1, wherein the elevator further comprises a pedestal below the traction sheave, and an overhead beam below the pedestal, and the step of guiding the loop from the first side of the traction sheave, over the traction sheave, to the second, opposite side of the traction sheave includes:

lifting the loop through the pedestal on the first side of the traction sheave and over the traction sheave, and lowering the loop through the pedestal on the second side of the traction sheave to below an overhead beam of the hoistway.

5. The method according to claim 1, wherein a first end of each of the hoisting ropes is initially fixed to a temporary fixing point on the elevator car, and is then detached from the temporary fixing point and then fixed to a final fixing point before the step of guiding the loop from the first side of the traction sheave, over the traction sheave, to the second, opposite side of the traction sheave.

6. The method according to claim 1, wherein the step of locating the loop around the counterweight diverting pulley comprises:

opening a lateral side support of the counterweight diverting pulley such that an opening is formed;

moving the loop through the opening at a lateral side of the counterweight diverting pulley and moving the loop along a shaft direction of the counterweight diverting pulley to a bottom of the counterweight diverting pulley, thereby locating the loop around the counterweight diverting pulley.

* * * * *